US006443565B2

(12) United States Patent
Fujii

(10) Patent No.: US 6,443,565 B2
(45) Date of Patent: Sep. 3, 2002

(54) INKJET RECORDING HEAD AND MANUFACTURING METHOD THEREOF, AND INKJET RECORDING APPARATUS

(75) Inventor: Masahiko Fujii, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/903,700

(22) Filed: Jul. 13, 2001

(30) Foreign Application Priority Data

Jul. 13, 2000 (JP) ..... 2000-213049

(51) Int. Cl.[7] ..... B41J 2/05; B41J 2/17
(52) U.S. Cl. ..... 347/65; 347/94
(58) Field of Search ..... 347/63, 65, 92, 347/93, 94, 44, 47

(56) References Cited

U.S. PATENT DOCUMENTS 5,485,186 A * 1/1996 Ishinaga et al. ..... 347/65
5,988,798 A * 11/1999 Hirasawa et al. ..... 347/65

FOREIGN PATENT DOCUMENTS

| | | | |
|---|---|---|---|
| JP | 5-24203 | 2/1993 | ..... B41J/2/16 |
| JP | 7-156411 | 6/1995 | ..... B41J/2/135 |
| JP | 9-1807 | 1/1997 | ..... B41J/2/05 |
| JP | 11-227208 | * 8/1999 | |

* cited by examiner

*Primary Examiner*—John Barlow
*Assistant Examiner*—Juanita Stephen
(74) *Attorney, Agent, or Firm*—Morgan, Lewis & Bockius LLP

(57) ABSTRACT

An inkjet recording head can compensate the drop volume change of ink droplets due to the cutting position deviation caused when nozzles are formed by cutting and can eject ink droplets having a constant drop volume stably regardless of the flow passage length. In manufacturing the head, less manufacturing processes are required and generation of off-specification products is suppressed, and the product is manufactured at low cost. The inkjet recording head is provided with individual flow passages having a pressure generation part with a pressure generation plane positioned in parallel to the flow of ink supplied in the nozzle direction having a nozzle at each end, which nozzle ejects ink droplets in the direction perpendicular to the normal line of the pressure generation plane. The flow passage has a region having the maximum cross-sectional area, a reducing region where the cross-sectional area reduces from the maximum cross-sectional area to the minimum cross-sectional area, and an expansion region where the cross-sectional area increases from the minimum cross-sectional area successively from the above-mentioned pressure generation part toward the nozzle direction in the cross-sectional area perpendicular to the above-mentioned ink flow direction.

8 Claims, 8 Drawing Sheets

INKJET RECORDING HEAD AND MANUFACTURING METHOD THEREOF, AND INKJET RECORDING APPARATUS

BACKGROUND OF THE INVENTION

1. Field of the Invention

This invention relates to an inkjet recording head and a manufacturing method thereof, and an inkjet recording apparatus in which ink droplets are ejected according to image information onto a recording medium for recording.

2. Description of the Related Art

Recently, the inkjet recording apparatus has attracted attentions as the low-cost high image quality color recording apparatus. There have been, for example, a piezo-type ink jet recording head that ejects ink from a nozzle with pressure generated by mechanically deforming a pressure chamber by use of piezoelectric material and a thermal type inkjet recording head that ejects ink from a nozzle with pressure generated by supplying a current to a heating element disposed on individual flow passage to thereby evaporate and expand ink.

In the case of these inkjet recording heads, a head chip on which an ink discharge mechanism for discharging ink droplets is mounted is jointed to the tip end of an ink supply member. In detail, ink is supplied from a tubular passage of the ink supply member to an ink supply opening of a head chip, and the ink is discharged from a nozzle.

In the case of the above-mentioned thermal type inkjet recording head, ink droplets are ejected onto a medium from a nozzle correspondingly to an image signal for recording. The driving force for ejecting ink droplets from a nozzle is generated by applying an electric pulse to an electric-heat conversion element (heat generator) to generate heat from the heat generator to thereby generate bubbles, and the bubbles causes pressure and the pressure functions to eject the ink droplets.

The schematic exemplary structure of an inkjet recording head is described herein.

The inkjet recording head is provided with a head chip having an ink discharge mechanism, for example, as shown in FIG. 4. As shown in FIG. 5, the head chip includes an ink discharge mechanism having at least a nozzle (discharge opening) 18 for ejecting ink droplets, an individual flow passage (ink flow passage) 20 for supplying ink toward the nozzle 18 that has the nozzle 18 at the one end, a pressure generation;.section 24 disposed on individual flow passage 20 having the pressure generation plane positioned in parallel to the ink flow that flows in the nozzle direction in the flow passage, and a common liquid chamber 22 disposed commonly to plural individual flow passages 20 for supplying ink to the individual flow passage, and additionally having an ink supply opening 26 for supplying ink from the external to the common liquid chamber 22 as required in some cases. In this case, the common liquid chamber 22 temporarily holds ink supplied from an external ink tank. The common liquid chamber is also served as a part of the liquid tank, and the tank is commonly connected directly to plural individual flow passages 20 so that ink is supplied to the individual flow passages 20.

In such an inkjet recording head, the pressure generation surface of the pressure generation section 24 is disposed in parallel to the ink flow that flows in the flow passage, and ink droplets are ejected from the nozzle into the direction perpendicular to the normal line of the pressure generation surface (side direction) (side ejecting type head).

A side ejecting type inkjet recording head as described hereinabove is manufactured from a substrate formed by joining an element substrate (equivalent to the above-mentioned pressure generation side broad) and a liquid flow passage substrate (equivalent to the above-mentioned flow passage substrate) as described in the Japanese Published Unexamined Patent Application No. Hei 11-227208.

The manufacturing process will be described in detail hereunder. An ink supply opening and an ink chamber (common liquid chamber) that are served for supplying ink from the external ink tank to an ink jet recording head are formed on a liquid flow passage substrate by means of wet anisotropic etching, and an individually formed ink flow passage (individual flow passage) is formed with high accuracy by means of reactive ion etching. In the case where a recess (recess 43 shown in FIG. 9 of the Japanese Published Unexamined Patent Application No. Hei 11-227208) is formed on a heating resistor, it is formed by means of wet anisotropic etching. On the other hand, a heating resistor (pressure generation section), an electrode, and a driving element are formed on the element substrate. The above-mentioned liquid flow passage substrate and element substrate are positioned fittingly and joined, and cut (diced) and separated into individual inkjet recording heads by use of, for example, a dicer. At that time, a nozzle (discharge opening) for ejecting ink droplets is formed by cutting at a predetermined dicing position by means of dicing.

However, in the case of the recording apparatus that ejects liquid from a nozzle, the configuration of ink droplet to be ejected and the ejecting performance depend on the flow passage length if the cross-sectional area of the ink flow passage (individual flow passage) having a nozzle at the one end is constant, the fluid resistance depends on the length. of the flow passage, and as the result it is impossible to keep the drop quantity (drop volume) of a ink droplet constant if the flow passage length is not constant.

In other words, if the cutting position deviates from the dicing position when a nozzle (discharge opening) is formed by dicing as described hereinabove, the drop volume changes and the liquid drop size changes irregularly, and as the result the high quality image cannot be obtained.

However, it is difficult to position the cutting position more accurately because the cutting involves a process of several $\mu$m order range, therefore the cutting process is involved in a problem with stabilization of high quality and obtaining high quality image. On the other hand, because the positional deviation as described hereinabove affects adversely on the image quality significantly, a process for checking the dicing position after cutting process is required and many inspection processes are required, and furthermore only the head chips that have passed the inspection for rejection of off-specification product are used, as the result the rejection results in the high cost of the accepted products.

Japanese Published Unexamined Patent Application No. Hei 7-156411 discloses an inkjet printing head for ejecting ink droplets in the normal line direction of the heating surface of a heater served as a heating body having the structure in which the cross-sectional area of the circular cross section of the nozzle part is curved outward in a curved surface from the center of the circular cross section of the flow passage increasingly from the minimum inside diameter part of the flow passage through which ink flows toward the nozzle discharge side direction. In the Patent Application, the suppression of printing quality due to meniscus vibration after refilling is described, but the length of the nozzle part of the inkjet printing head described herein is determined by the plate thickness, and the relation between the length and the drop volume of a ink droplet is not described. In other words, in the case of the curved structure in which the flow passage is curved from the center toward the outside, it is difficult to reduce the change of the drop volume of ink droplets corresponding to the flow passage length difference and to keep the drop volume of ejected ink constant. As the result, it is impossible to resolve the problem in the manufacturing process and the problem of high cost due to the deviation of the cutting position as described hereinabove.

In the case where plural nozzles for ejecting ink droplets are formed by use of a dicer or the like as in the case of the above-mentioned side ejecting type inkjet recording head, it is quite difficult to cut without any deviation of the cutting position. A method has not been known that is used for forming nozzles stably so that the length of the flow passage having a nozzle at the one end is controlled within a range in which the configuration of ejected ink droplets and the ejecting characteristics are not affected adversely.

The present invention has been made in view of the above-mentioned circumstances and to solve the above-mentioned problem, and provides an inkjet recording head that is capable of compensating the change of drop volume due to the deviation of the cutting position in dicing or the like when cutting and forming a nozzle, and ejecting ink droplets of a constant drop volume independently of the flow passage, which inkjet recording head is manufactured with less manufacturing processes and with suppressed generation of off-specification products to result in low-cost products.

Furthermore, the present invention provides a low-cost inkjet recording apparatus that is capable of ejecting ink droplets of a constant drop volume to thereby form a high quality image.

Furthermore, the present invention provides a method for easily manufacturing an inkjet recording head that is capable of compensating the change of drop volume due to the deviation of the cutting position in dicing or the like, and stably ejecting ink droplets of a constant drop volume, which inkjet recording head is manufactured with less manufacturing processes and with suppressed generation of off-specification products to result in low-cost products.

SUMMARY OF THE INVENTION

The above-mentioned problem is solved by applying the followings.

An aspect of the present invention provides an inkjet recording head having a head chip on which an ink discharging mechanism is mounted, the ink discharging mechanism having at least individual flow passages each having a nozzle at one end thereof and a pressure generation part with a pressure generation plane positioned in parallel to a direction of flow of ink in the nozzle, and a common liquid chamber communicated commonly to plural individual flow passages that supplies ink to the individual flow passages. The individual flow passage has a region having a maximum cross-sectional area, a reducing region where a cross-sectional area thereof reduces from the maximum cross-sectional area to a minimum cross-sectional area, and an expansion region where a cross-sectional area thereof increases from the minimum cross-sectional area successively from the pressure generation part toward the nozzle, the regions being perpendicular to the ink flow direction.

The cross-sectional area of the expansion region may increase so as to almost offset an increase of a flow passage resistance caused by making the individual flow passage of the expansion region longer.

Alternatively, the cross-sectional area of the expansion region may increase so as to keep an ejected ink droplet volume almost unchanged even if the individual flow passage of the expansion region is made longer.

With the above configurations, the cross-sectional area of each individual flow passage extending from the region having the maximum cross section area on which the pressure generation part is provided to the nozzle, which cross section is perpendicular to the ink flow direction of the individual flow passage, is reduced from the maximum cross section area to the minimum cross-sectional area and then increased from the minimum cross-sectional area. As the result, even if the length of the flow passage of an individual flow passage having the nozzle at the one end thereof deviates from a certain specified range when nozzles that are served for ejecting ink droplets are cut and formed by dicing, the inkjet recording head can eject ink droplets having a constant drop volume stably regardless of the length of the flow passage.

Furthermore, it is not necessary to inspect the cut position and the inspection process is not necessary, the generation of off-specification products rejected during inspection is significantly suppressed, and as the result the low-cost inkjet recording head is implemented.

Also in the above aspect, the cross-sectional area of the nozzle that is formed at one end of the individual flow passage may be one to two times as large as the minimum cross-sectional area.

With the above configuration, because the cross-sectional area of a nozzle that forms the one end of an individual flow passage increases gradually from the minimum cross-sectional area to a cross-sectional area ranging from the minimum cross-sectional area to the doubled minimum cross-sectional area, it is possible to compensate the drop volume of ink droplets ejected from the nozzle so as to be constant regardless of a slight change of the flow passage length of the individual flow passage. In other words, if the cross-sectional area is different due to the different length of the flow passage, for example, if the flow passage length is longer than a predetermined value, then the liquid resistance that the ink receives is larger than the value corresponding to the predetermined flow passage length and the drop volume of ejected ink droplets is smaller than the expected value, but the increase of the fluid resistance is suppressed (compensated) because the cross-sectional area is larger than the predetermined value by a value equivalent to the increase of the fluid resistance, and as the result the drop volume is kept almost constant.

The flow rate of ink that flows in a flow passage is not affected in the above-mentioned range, and the high speed motion is not affected.

Also in the above aspect, the expansion region may include an increasing region where the cross-sectional area thereof increases in proportion to a length of the expansion region in the ink flow direction.

With the above configuration, the expansion region of an individual flow passage is provided with the increasing region where the cross-sectional area of the individual flow passage increases in proportion to the length of the expansion region in the ink flow direction, that is, the cross-sectional area increasing rate B that is assigned to the ordinate axis increases linearly with the length A in the ink flow direction of the region that is assigned to the abscissa axis (proportional relation; $B=aA$). Therefore, for example, the configuration of the increasing region is quadrangular pyramid-shaped if the cross-sectional configuration is rectangular, or is triangular pyramid-shaped if the cross-sectional configuration is triangular, and the configuration of the increasing region is pyramid-shaped regardless of the cross-sectional configuration. As the result, the cross-sectional area of the cross-sectional area of the increasing region increases in proportion to the length of the region in the ink flow direction at a constant rate and the increase of the fluid resistance due to the longer flow passage length is offset. In other words, because the fluid resistance of the ink is compensated correspondingly to the magnitude of the flow passage length, the drop volume is kept almost constant.

Also in the above aspect, an increasing rate of the cross-sectional area that increases from the nozzle side end of the increasing region toward the nozzle end may be smaller than the increasing rate of the cross-sectional area of the increasing region.

With the above configuration, the increasing rate of the cross-sectional area from the cross section that is the nozzle side end of the increasing region where the cross-sectional area increases proportionally at a constant rate toward the nozzle direction is gradually reduced from the increasing rate of the cross-sectional area of the increasing region. In other words, the increasing rate of the cross-sectional area decreases with increasing length as in the case of the increasing region, and finally the increasing rate is reduced to almost zero (0<increasing rate<a). As the result, even in the case where the flow passage length deviates significantly from the predetermined specified value, the drop volume does not increase significantly, and an image is formed with ink droplets having a constant drop volume.

Also in the above aspect, a nozzle surface having an opening may be formed by cutting a substrate comprising a pressure generation side substrate provided with the pressure generation part and a flow passage substrate.

With the above configuration, the nozzle surface formed on the one end of an individual flow passage that ejects ink droplets is formed by cutting a substrate (head chip joined substrate) including a pressure generation side substrate and a flow passage substrate at a predetermined position. Plural nozzle openings are positioned on the nozzle surface. Because the head chip joined substrate previously having plural ink discharging mechanisms is cut at the predetermined position and plural nozzles are formed in one cutting operation, the manufacturing process can be simplified and the product is manufactured at low cost advantageously.

The present invention provides an inkjet recording apparatus provided with the inkjet recording head as described above. Because the inkjet recording apparatus is provided with an inkjet recording head described hereinabove, ink droplets having a constant drop volume are ejected stably, and a sharp and high quality image can be formed. Furthermore, a low-cost inkjet recording apparatus can be implemented because the inkjet recording head can be manufactured at low cost as described hereinabove.

According to another aspect of the present invention, a method for manufacturing an inkjet recording head has the steps of joining a flow passage substrate on which plural grooves to serve as individual flow passages to which ink is supplied and a pressure generation side substrate provided with a pressure generation part for forming a joined substrate constituting a head chip, and cutting the joined substrate to form the plural individual flow passages each having an opening at an end thereof that is served as a nozzle. Each individual flow passage has a region having a maximum cross-sectional area, a reducing region where a cross-sectional area thereof decreases from the maximum cross-sectional area to a minimum cross-sectional area, and an expansion region where a cross-sectional area increases from the minimum cross-sectional area, successively toward the nozzle, the regions being perpendicular to a direction of the ink flow in the nozzle, and each individual flow passage is cut at the expansion region by means of dicing.

The cross-sectional area of the expansion region may increase so as to almost offset an increase of a flow passage resistance caused by making the individual flow passage of the expansion region longer.

The cross-sectional area of the expansion region may increase so as to keep an ejected ink droplet volume almost unchanged even if the individual flow passage of the expansion region is made longer.

Because a flow passage is cut at the expansion region where the cross-sectional area increases gradually from the minimum cross-sectional area, even if the flow passage length deviates from a predetermined range, the cross-sectional area changes correspondingly to the change of the fluid resistance due to the change of the flow passage length as described hereinabove, and as the result an inkjet recording head that is capable of ejecting ink droplets having a constant drop volume stably can be manufactured. Furthermore, the inspection process for inspecting the cutting position can be eliminated, the generation of off-specification products is suppressed significantly, and as the result the inkjet recording head can be manufactured simply at low cost.

The present invention provides a method for manufacturing an inkjet recording apparatus in which the method for manufacturing the inkjet recording head described above is employed.

BRIEF DESCRIPTION OF THE DRAWINGS

Preferred embodiments of the present invention will be described in detail based on the followings, wherein.

DETAILED DESCRIPTION OF THE PREFERRED EMBODIMENTS

An inkjet recording head of the present invention employs a head chip on which a side ejecting type ink discharging mechanism is mounted, and is provided with an individual flow passage having a pressure generation part with a pressure generation surface positioned in parallel to the ink flow in the nozzle direction. In the cross section of an individual flow passage perpendicular to the direction of the above-mentioned ink flow, the individual flow passage has a region having the maximum cross-sectional area, the reducing region in which the cross-sectional area decreases from the maximum cross-sectional area to the minimum cross-sectional area, and the expansion region in which the cross-sectional area increases from the minimum cross-sectional area in the nozzle direction from the above-mentioned pressure generation part. The side ejecting type ink discharging mechanism is basically provided with a nozzle, an individual flow passage having the nozzle at the one end thereof and having a pressure generation part with a pressure generation surface positioned in parallel to the ink flow in the nozzle direction, and a common liquid chamber communicated commonly to plural individual flow passages served for supplying ink to the individual flow passages.

An inkjet recording apparatus of the present invention is provided with an inkjet recording head of the above-mentioned present invention.

In a method for manufacturing an inkjet recording head of the present invention, a nozzle is formed by cutting an individual flow passage having the region of the maximum cross-sectional area, the region of the reducing area, and the expansion region having the area that increases from the minimum cross-sectional area by means of dicing at the expansion region.

The inkjet recording head and the manufacturing method thereof, and the inkjet recording apparatus of the present invention will be described in detail hereinafter.

<Inkjet Recording Head and the Manufacturing Method Thereof>

First Embodiment

An inkjet recording head in accordance with the first embodiment of the present invention will be described hereinafter with reference to FIG. 1 to FIG. 5 and FIG. 8 to FIG. 11. Also, a method for manufacture of an inkjet recording head will be described in detail in the description of the above. A head chip that is a component of the inkjet recording head will be described at the first place and the inkjet recording head provided with the head chip will be described next.

Figure 4A:
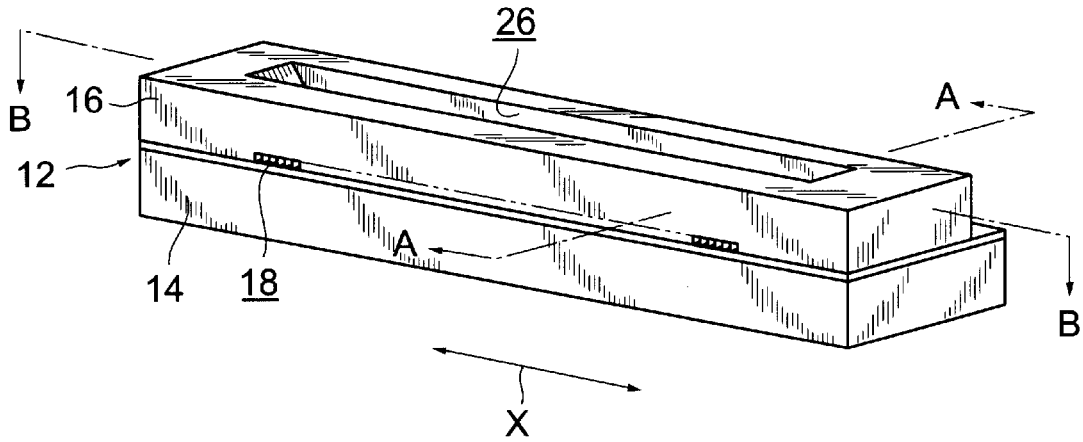
FIG. 4A is a perspective view illustrating a head chip and an ink supply opening in accordance with the first embodiment of the present invention.
Figure 4B:
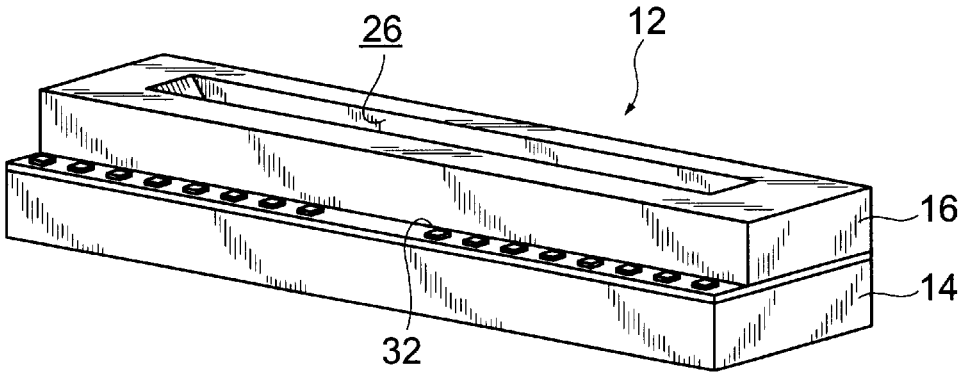
FIG. 4B is a perspective view illustrating the back side of the head chip.
Figure 5:
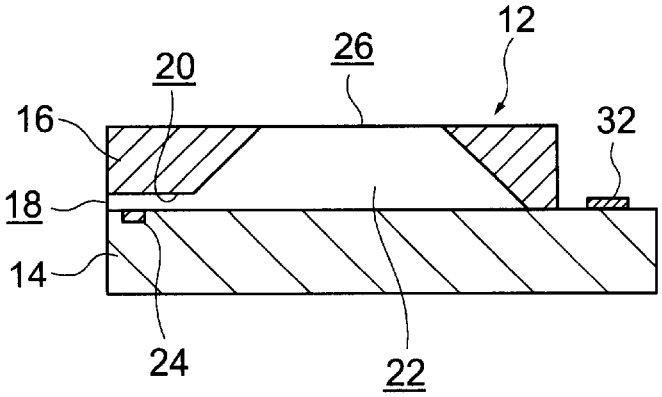
FIG. 5 is a cross-sectional view along the line A—A of FIG. 4A.

As shown in FIG. 4A, FIG. 4B, and FIG. 5, the head chip 12 that is the component of the inkjet recording head 10 (refer to FIG. 14) is formed by joining a pressure generation side substrate 14 formed by fine processing of a silicon wafer and a flow passage substrate 16 formed by etching a groove that is served as the flow passage of liquid, and is basically provided with plural nozzles 18 formed on the one end surface, individual flow passages 20 communicated to the nozzles 18 respectively, a common liquid chamber 22 communicated to all the individual flow passages 20 extending in the nozzle arrangement direction, and a pressure generation part 24 disposed facing to the individual flow passages 20.

The flow passage substrate 16 can be manufactured by use of an LSI manufacturing equipment and manufacturing method or the like. For example, a flow passage substrate 16 can be formed by etching a single crystal silicon to form a common liquid chamber 22 and grooves that are served as individual flow passages 20. The crystal anisotropic etching or reactive ion etching (RIE) that is described in Japanese Published Unexamined Patent Application No. Hei 11-227208 may be used as the etching method.

In the crystal anisotropic etching, an etching mask is patterned on a silicon wafer having, for example, a (100) crystal plane on the surface and the silicon wafer is etched using a heated aqueous solution of potassium hydroxide (KOH) or the like. The etching solution such as an aqueous solution of tetramethyl ammonium hydroxide (TMAH) may be used other than an aqueous solution of potassium hydroxide (KOH). The reactive ion etching (RIE) is described in Japanese Published Unexamined Patent Application No. Hei 11-227208.

The pressure generation side substrate 14 is manufactured by use of an LSI manufacturing equipment and manufacturing method. For example, a pressure generated by mechanically deforming a pressure chamber by means of piezoelectric material or an evaporation expansion pressure generated concomitantly with heating when a current is directly supplied to a heating body (heating element) provided on a individual flow passage may be used as the pressure given from the pressure generation part 24. A piezo type inkjet recording head is manufactured in the former case, and a thermal type inkjet recording head is manufactured in the latter case.

In the case where a heating element is used as the pressure generation part 24, for example, a heat storage layer formed of silicone oxide is provided on the single crystal silicon surface and a heating element is formed on the top of the heat storage layer. Plural heating elements are formed and connected to restrictive signal lines for supplying of the power and signal. A heating element is heated by means of a signal supplied from a driving circuit or the like provided in the same chip or outside the chip. A protection layer having a single-layer or plural-layer, structure formed of silicon oxide, silicon nitride,.or tantalum is formed on the top of a heating element. Furthermore, a resin layer is formed on the layer as a protection layer for protecting it from liquid. For example, photosensitive resin is coated on the resin layer and patterned by means of photolithography process. For example, photosensitive polyimide may be used as the photosensitive resin. Polymer material such as non-photosensitive polyimide dry film may be used other than photosensitive polyimide. Before the patterning of the resin layer, resin on the heating element and electric signal terminal must be removed.

The edge of the above-mentioned patterned resin layer is deformed convex due to film shrinkage during heat setting process. The thick convex resin layer is formed on the periphery of the substrate. Because such convex will cause failed joint in joining process, the resin layer is flattened by means of chemical mechanical polishing (CMP) to remove the convex.

In the present embodiment, the common chamber 22 is communicated to individual flow passages 20, provided with respective ink supply openings 26 formed in the direction perpendicular to the respective individual flow passages 20 (arrow X direction), and ink is supplied to the common chamber 22 from an ink tank or the like disposed in the external not shown in the drawing.

As shown in FIG. 4B, electric signal input/output terminals 32 are provided on the back side of the nozzle 18 forming surface of the head chip 12. A driving circuit (not shown in the drawing) for driving the pressure generation part 24 is provided on the common liquid changer 22 side of the pressure generation side substrate 14.

Figure 1:
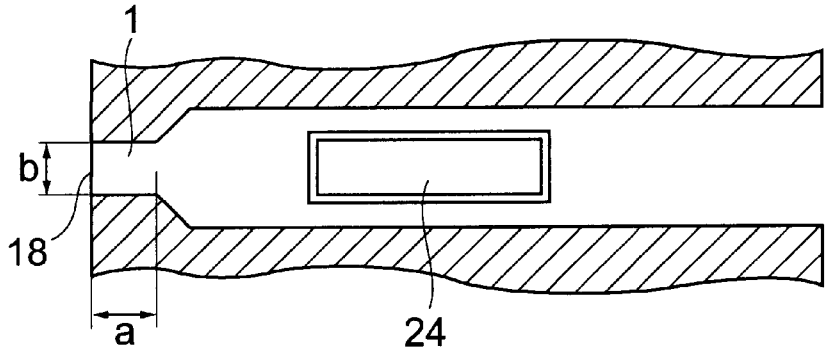
FIG. 1 is a cross-sectional view along the line B—B of FIG. 4A illustrating an exemplary cross-sectional structure of an individual flow passage.

As shown in FIG. 1 and FIG. 5, a pressure generation part 24 for pressurizing the internal of a flow passage between the common liquid chamber 22 and a nozzle 18 is provided on an individual flow passage 20 of the head chip 12, and the cross-sectional area of the individual flow passage 20 is maximum at least in the region of the pressure generation part 24. The term "cross-sectional area" used herein means the cross-sectional area of the flow passage cross section (cross section of an individual flow passage 20) perpendicular to the flow direction of ink flowing in the individual flow passage 20. The same is true in the following.

An individual flow passage 20 may have the maximum cross-sectional area from the common liquid chamber 22 as shown in FIG. 1, furthermore, at the end of the flow passage not connected to the common liquid chamber, a first narrow part 1 is formed through the area where the cross-sectional area is reduced from the maximum cross-sectional area, and a nozzle 18 is formed at the end of the first narrow part 1.

The structure will be described in detail with reference to FIG. 2. From the region A having the maximum cross-sectional area of the individual flow passage 20 toward the nozzle 18, the region B having the cross-sectional area that is reducing from the maximum cross-sectional area to the minimum cross-sectional area, and the expansion region C having the cross-sectional area that is increasing from the minimum cross-sectional area again are formed.

The shape of the cross-sectional area of the individual flow passage 20 is arbitrary and may be selected from various shapes such as triangle, trapezoid, and rectangle.

As described hereinabove, the reduction region B has the narrow cross-sectional area, and the narrow cross-sectional area functions to concentrate the pressure to the nozzle 18 when the pressure is generated. In other words, the energy efficiency is improved and the discharge speed of ink discharged from the nozzle 18 is increased, and as the result the image quality is improved.

Next, a method for forming a nozzle and an expansion region C (first narrow part 1) having the nozzle at the end will be described.

Figure 6:
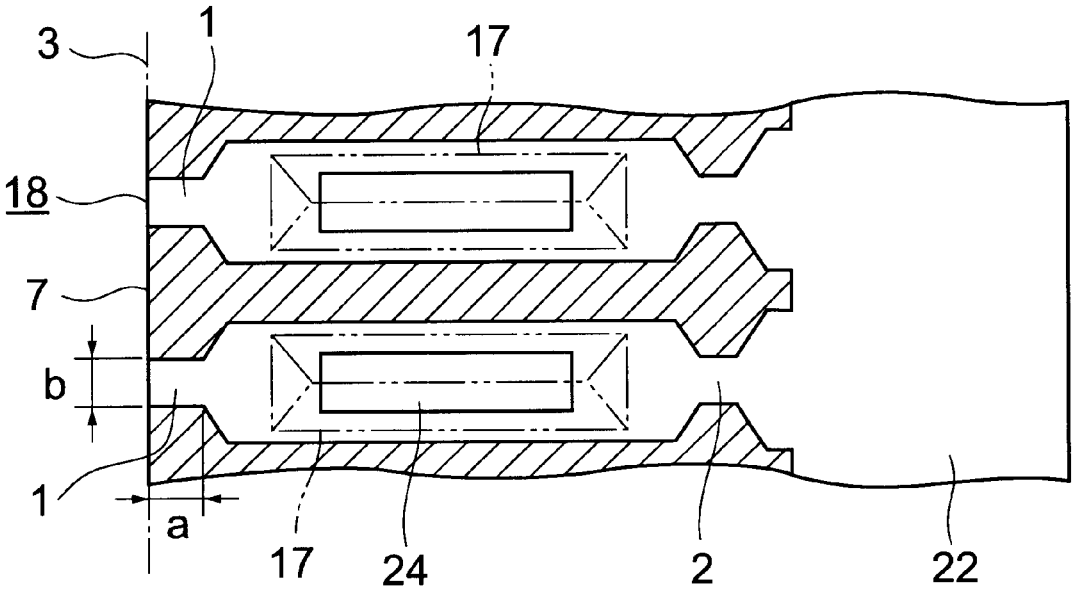
FIG. 6 is a cross-sectional view along the line B—B of FIG. 4A illustrating an exemplary cross-sectional structure of individual flow passages.

As described hereinabove, the head chip 12 is provided with the pressure generation side substrate 14 and the flow passage substrate 16 that are joined together (head chip joined substrate). A head chip joined substrate is cut by dicing at the predetermined position 3 as shown in FIG. 6 to form individual head chips so as to form the nozzle surface 7 including the nozzle opening, and thus a head chip 12 is formed. Therefore, plural nozzles 18 that are arranged as shown in FIG. 4A are formed in one cutting operation. Herein, FIG. 6 is a cross-sectional view illustrating an exemplary cross-sectional structure of plural individual flow passages in a cross section taken along B—B line of FIG. 4A.

In this case, it is desirable that nozzles 18 are cut precisely along the predetermined position D (refer to FIG. 2) ideally, however, nozzles 18 are often cut with some deviation at, for example, the position D' actually, as the result the length a of the individual flow passages 20, particularly the first narrow parts 1, cannot satisfy a certain specified range. Generally, if the longer individual flow passage 20, particularly the first narrow part 1, results in increased flow passage resistance of ink, and the drop volume of ink droplets to be ejected decreases in the case where the cross-sectional area of the cross section is constant.

In view of the above, in the present invention, the cross-sectional area of the flow passage cross section of the expansion region C where a nozzle is formed is formed so as to increase from the minimum cross-sectional area with the increase of the length a of the expansion region C. The magnitude of expansion of the cross-sectional area of the cross section of the expansion region C is described hereunder. The cross-sectional area of a nozzle may be larger than the minimum cross-sectional area with the increase the length a of the expansion region C so that the drop volume of ink droplets to be ejected is approximately constant.

In the present invention, it is preferable that the expansion region C has the structure that satisfies the range (1) and/or (2) described hereunder.

(1) The nozzle cross-sectional area is larger than the minimum cross-sectional area by a factor of 1 to 2. If the factor is a value exceeding 2, then the factor results in the drop volume that is larger than that corresponding to the flow passage length, and the drop volume of ink droplets cannot be compensated so as to be constant.

If the flow passage length is longer than the prescribed value, then the longer flow passage length results in increased fluid resistance of ink and a smaller drop volume of ink droplets to be ejected, the increase of the fluid resistance is compensated by the expansion of the cross-sectional area that is equivalent to the increase of the fluid resistance because of the relation that longer/shorter flow passage length makes the cross-sectional area large/small in the above-mentioned range, and thus the effect of increase of the fluid resistance is suppressed (compensated). As the result, the constant drop volume is obtained regardless of the cutting position deviation in dicing.

Furthermore, (2) it is desirable that the expansion region C where the cross-sectional area increases from the minimum cross-sectional area includes an increasing region where the cross-sectional area increases in proportion to the length of the region in the ink flow direction.

In detail, the cross-sectional area of the increasing region increases linearly in the relation between the length A of the region in the ink flow direction on the abscissa and the cross-sectional area increase B on the ordinate. In other words, the increasing region has a pyramid shaped configuration having the area that increases toward the nozzle 18, and the increasing region therefore has multi-plane structure. For example, in the case where the cross-sectional shape of the region is rectangular, the increasing region has a quadrangular pyramid configuration, on the other hand in the case where the cross-sectional shape of the region is triangular, the increasing region has a triangular pyramid configuration.

Therefore, because the cross-sectional area increases at a constant rate in proportional to the length in the ink flow direction, the change of fluid resistance can be offset and compensated, and as the result the approximately constant drop volume can be obtained regardless of the cutting position deviation in dicing.

In detail, the expansion region C is formed as described hereinafter.

Particularly, the reactive ion etching (RIE) is advantageous as the etching method for forming a groove that is served as the fluid flow passage of the flow passage substrate in that the arbitrary plane configuration can be obtained precisely and the width of, for example, the rectangular flow passage (the length b in FIG. 2) can be controlled arbitrarily. The process for forming an exemplary individual flow passage having a rectangular cross section will be described hereunder.

Figure 2:
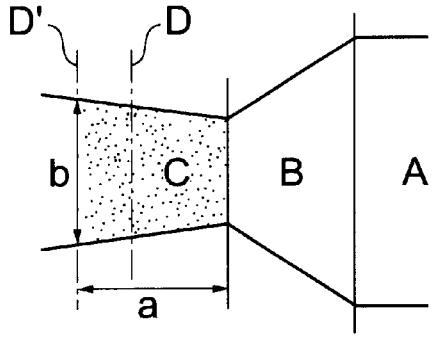
FIG. 2 is a schematic cross-sectional view illustrating a nozzle that is the one end of the individual flow passage and a first narrow part.
Figure 8:
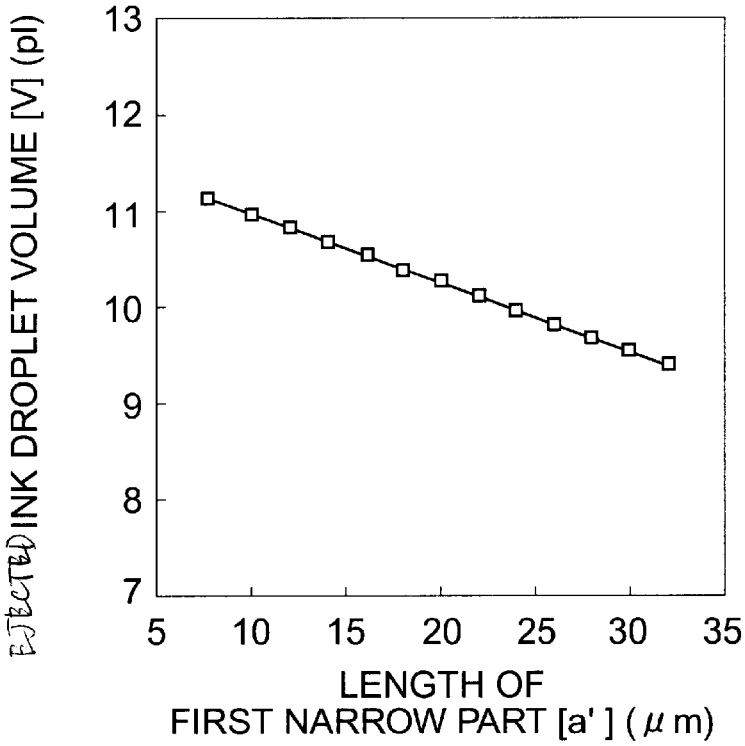
FIG. 8 is a graph for describing the relation between the length a' of a narrow part and the ejected ink droplet volume V for an exemplary conventional inkjet recording head.

It is assumed that the cross-sectional area of the cross section of the region (referred to as "region c'" hereinafter) that is equivalent to the expansion region C (first narrow part 1) of the above-mentioned individual flow passage 20 is constant up to the nozzle and the size of the region other than the region c' is fixed to a certain constant value in the head chip (refer to FIG. 1 and FIG. 2 shown in the Japanese Published Unexamined Patent Application No. Hei 11-227208) that is a component of an ink jet recording head of a liquid ejection recording apparatus described in the Patent Application having the individual flow passage of rectangular cross section shape. In this case, the relation between the drop volume (pi (picoliter); referred to as "ejected ink droplet volume" hereinafter) of ink droplets ejected from a nozzle and the length a' of the above-mentioned region c' (equivalent to the length a of the first narrow part 1 in the present embodiment; refer to FIG. 2) is shown in FIG. 8. In this case, the cross section of the region c' is rectangular, and the width b' (equivalent to the length b in FIG. 2) is 15 $\mu$m.

It is found from FIG. 8 that the theoretical ejected ink droplet volume is 10.3 pl at the length a'=20 $\mu$m and the ejected ink droplet volume changes linearly with changing of the length of the narrow part. In other words, if the length of the narrow part is shorter than a prescribed value due to deviation of the cutting position caused when the nozzle surface having a nozzle opening is formed by dicing or the like, then the ejected ink droplet volume becomes smaller. The reason is that the fluid resistance of the fluid in the region ranging from the heating part to the nozzle becomes larger, and the balance of the property of the fluid located between ahead and behind of the heating resisting body (fluid resistance and inertance) changes. On the other hand, if the length is shorter, the ejected ink droplet volume becomes larger. Herein, the change magnitude of the ejected ink droplet volume to the change magnitude of the length a' is 0.07 pl/$\mu$m.

Figure 9:
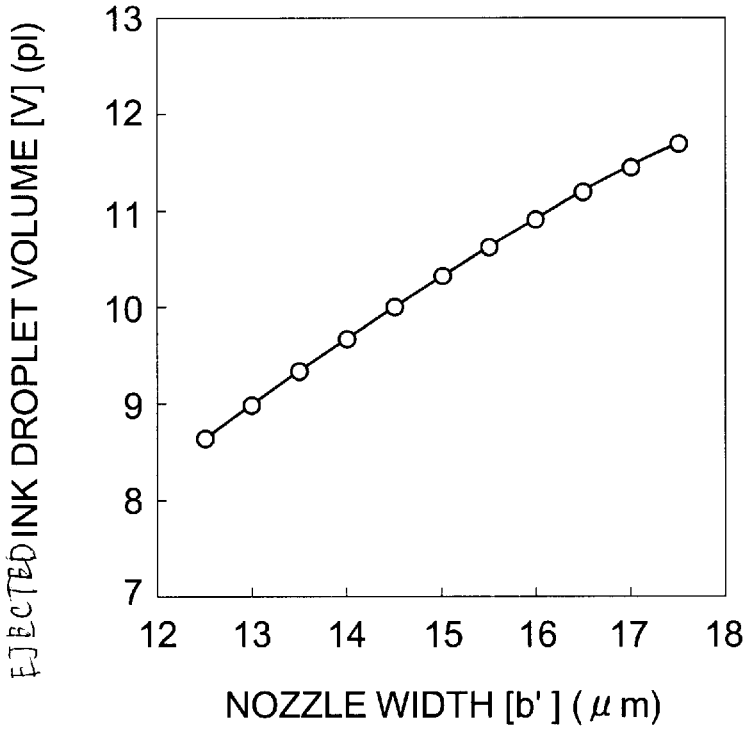
FIG. 9 is a graph for describing the relation between the length b' of a nozzle width and the ejected ink droplet volume V for the exemplary conventional inkjet recording head.

Under the same condition described hereinabove, in the case of a head chip of a liquid ejection recording apparatus described in Japanese Published Unexamined Patent Application No. Hei 11-227208 (refer to FIG. 1 and FIG. 2 in the Patent Application), the relation between the ejected ink droplet volume and the width length b' of the rectangular cross section is shown in FIG. 9. In this case, the length a' of the above-mentioned region c' (predetermined value) is 20 $\mu$m.

Both relations can be approximated by the following second order curve, wherein the ejected ink droplet volume is denoted by V. Of course, the ejected ink droplet volume V =10.3 pl at the width length of the rectangular cross section b'=15 $\mu$m.

$$V=-0.024(b')^2+1.34b'-4.4$$

Figure 10:
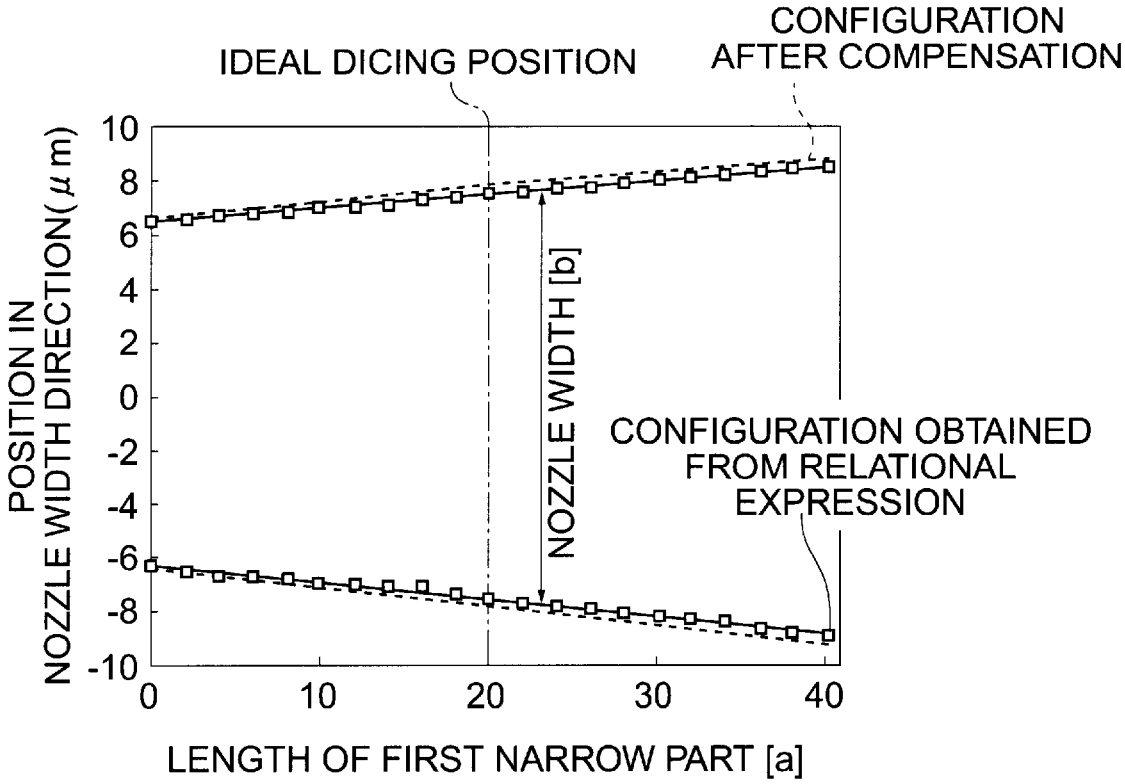
FIG. 10 is a graph for describing the configuration in the nozzle width direction of a first narrow part of an inkjet recording head in accordance with the first embodiment of the present invention.

The relation between the length a of the expansion region C and the width length b in the nozzle width direction of the first narrow part 1 that satisfies the constant jet droplet volume V (=10.3 pl) is obtained based on the relation between the ejected ink droplet volume V, the length a' of the narrow part, and the width length b' of the rectangular cross section that is represented as described hereinabove, and the obtained relation is plotted as shown in FIG. 10.

In FIG. 10, the center line of the width length b is represented by 0 $\mu$m, and the width length b that compensates the increase of the length a of the first narrow part to maintain the ejected ink droplet volume V constant is shown. In detail, the area region between two solid lines (including □) in the drawing represents the configuration in the nozzle width direction of the expansion region C obtained from the above-mentioned relational expression.

However, it is required to compensate the solid line shown in FIG. 10 when the configuration in the nozzle width direction is set actually. The reason is described hereunder. For example, in the case where the width configuration is formed according to the configuration shown with the two solid lines in FIG. 10 and it is cut at the position of the length a (set value)=20 $\mu$m, the width of the region near the pressure generation part is formed narrow, and as the result the fluid characteristics and inertance at the first narrow part becomes larger than that of the head chip described in the above-mentioned Patent Application (Japanese Published Unexamined Patent Application No. Hei 11-227208) in which the cross-sectional area of the region c' is constant.

Therefore, as shown with the two dotted lines in FIG. 10, in the case where the fluid characteristics in the region c' satisfy the above-mentioned relational expression between the ejected ink droplet volume V, the length a, and width length b, it is required to compensate the nozzle width length b of the first narrow part slightly larger so as to be equalized to the case where the cross-sectional area of the region c' is constant.

A first narrow part (expansion region C) having the configuration compensated as described hereinabove was formed, and plural head chips were manufactured with changing the dicing position:by means of dicer, namely with changing the length a of the first narrow part in the present embodiment. The ejected ink droplet volume was measured on these head chips to obtain the result shown in FIG. 11. Based on the result, it is found that ink droplets having approximately constant ejected ink droplet volume (drop volume of ink) are ejected stably regardless of the length of the individual flow passage, particularly regardless of the length of the first narrow part.

Second Embodiment

Next, an inkjet recording head in accordance with the second embodiment of the present invention will be described. The same components as used in the first embodiment are given the same reference characters and a detailed description is omitted.

Figure 3:
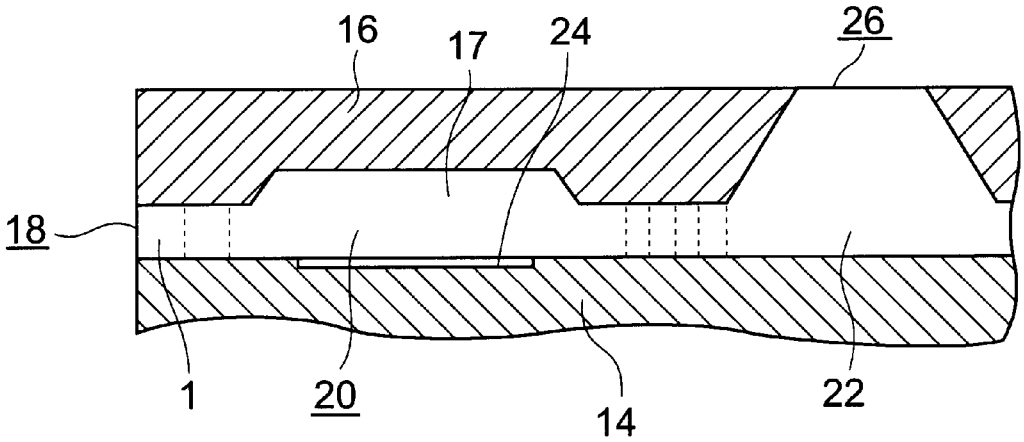
FIG. 3 is an enlarged cross-sectional view of the region including the individual flow passage shown in FIG. 5.

As shown in FIG. 3, an individual flow passage 20 has a recess 17 formed on the upper inside wall surface of the pressure generation part 24. In other words, the flow passage substrate 16 is formed convex toward the pressure generation side substrate 14 excepting the part of the pressure generation part 24. FIG. 3 is an enlarged cross-sectional view including the individual flow passage shown in FIG. 5 along the A—A line cross section of FIG. 4A.

Therefore, a slope is provided in the nozzle direction on the nozzle side of the recess 17, and the pressure exerted from the pressure generation part 24 in the flow passage during ink ejecting, namely the pressure caused concomitantly with growing of bubbles generated when ink is heated, for example, in the case of a heating resistor, is concentrated in the nozzle 18 direction. Thereby, the flight speed of ink droplets increases and the recording is stabilized. Moreover, because the decreasing region is provided on the individual flow passage 20, the effect of the decreasing region is added to the effect of the slope in the nozzle direction of the region, and as the result the utilization efficiency of the pressure is further improved.

Third Embodiment

Next, an inkjet recording head in accordance with the third embodiment of the present invention will be described. The same components as used in the first embodiment are given the same characters and a detailed description is omitted.

As shown in FIG. 6, an individual flow passage 20 has a second narrow part 2 formed between the common liquid chamber 22 and the pressure generation part 24. The second narrow part 2 has two slopes in the direction of the nozzle 18 and common liquid chamber 22. FIG. 6 is a cross-sectional view along the line A—A of FIG. 4A.

Therefore, the slope in the common liquid chamber direction functions to concentrate the pressure exerted from the pressure generation part 24 to the internal of the flow passage during ink ejecting to the direction of the nozzle 18. On the other hand, the slope in the nozzle direction functions to reduce the fluid resistance caused when the fluid flows from the common liquid chamber 22 to the pressure generation part 24 to thereby improve the ink supply.

Thereby, the recording is stabilized.

Furthermore, an embodiment in which a recess 17 is formed on the upper inside wall surface of the pressure generation part 24 as in the case of the second embodiment and also the second narrow part 2 is formed may be employed. This embodiment gives improved utilization efficiency of the pressure in the nozzle direction and improved ink supply, and the recording is further stabilized.

Fourth Embodiment

Subsequently, an inkjet recording head in accordance with the fourth embodiment of the present invention will be described. The same components as used in the first and third embodiments are given the same characters and a detailed description is omitted.

Figure 7:
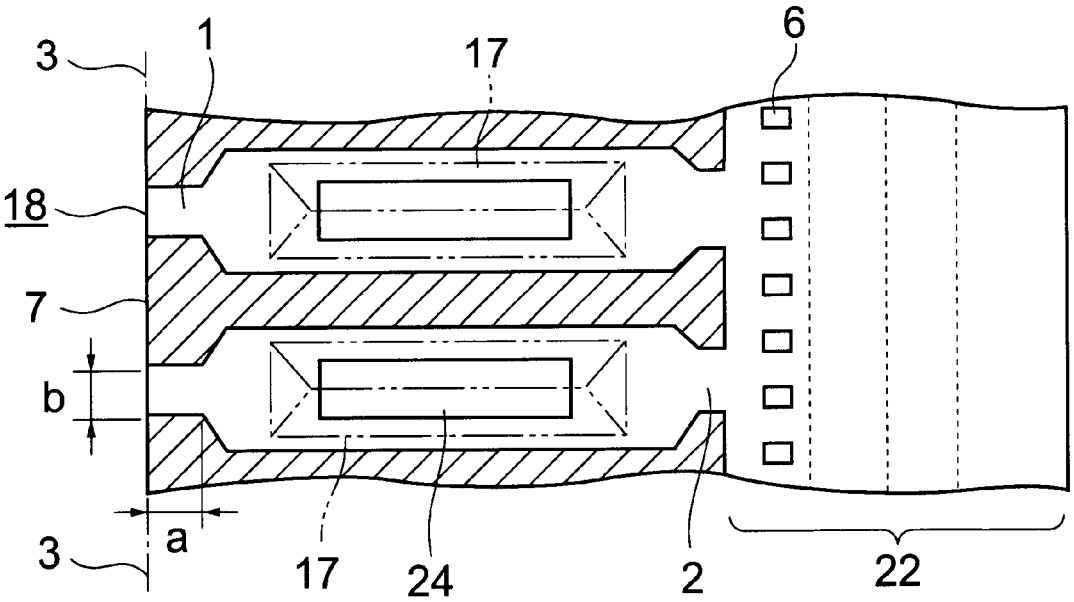
FIG. 7 is a cross-sectional view along the line B—B of FIG. 4A illustrating an exemplary cross-sectional structure of individual flow passages.

As shown in FIG. 7, an individual flow passage 20 has a second narrow part 2 that is wide in the direction parallel to the arrow X (refer to FIG. 4A) formed between the common liquid chamber 22 and the pressure generation part 24, and a filter part 6 is formed in the common liquid chamber 22. FIG. 7 is a cross-sectional view along the line A—A of FIG. 4A.

The filter part 6 functions to remove foreign material such as dust that flows into the common liquid chamber 22 mixed with ink supplied from the external, and functions to prevent the nozzle from clogging. The slope in the common liquid chamber direction functions to concentrate the pressure exerted from the pressure generation part 24 to the internal of the flow passage during ink ejecting to the direction of the nozzle 18, and the ink supply from the common liquid chamber 22 to the pressure generation part 24 is not blocked though the slope in the nozzle direction is not formed differently from the third embodiment because the width of the second narrow part 2 is formed wide. Thereby, the recording is stabilized.

Fifth Embodiment

Figure 13:
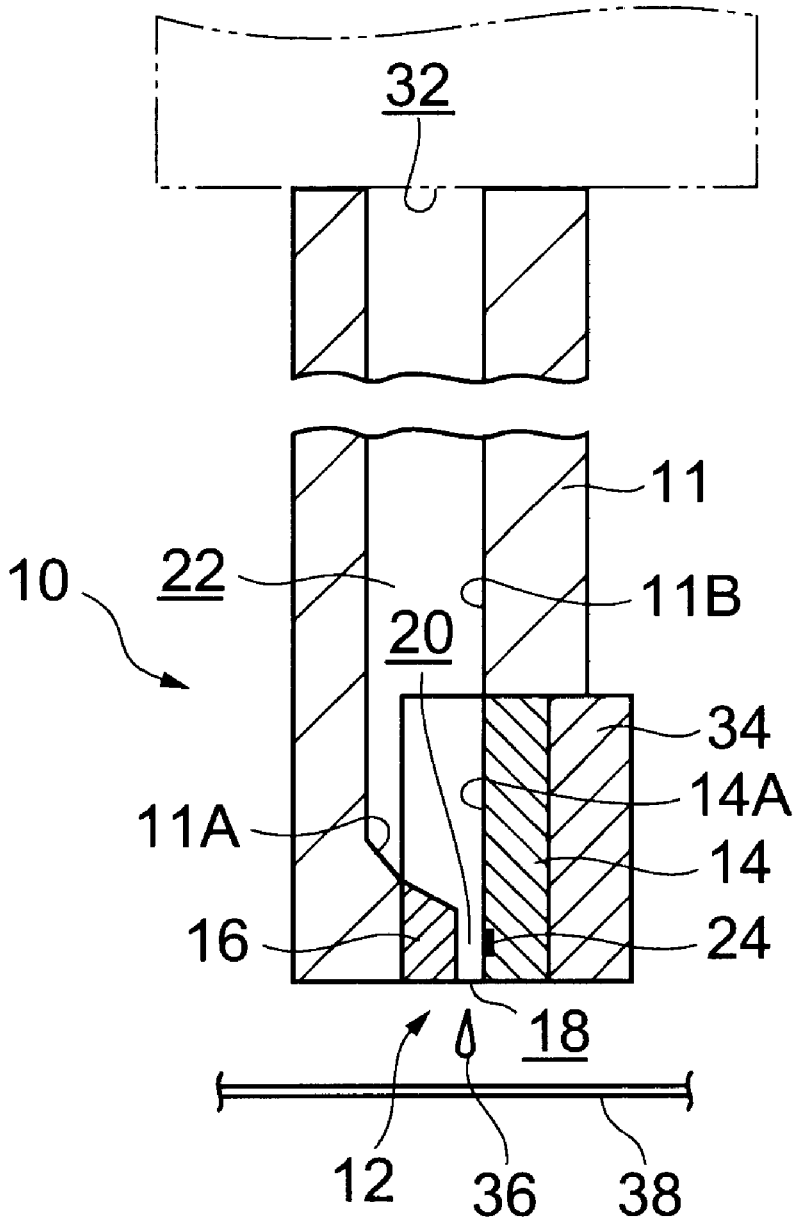
FIG. 13 is a cross-sectional view of an inkjet recording head in accordance with the fifth embodiment of the present invention.

Subsequently, an inkjet recording head in accordance with the fifth embodiment of the present invention will be described. The same components as used in the first embodiment are given the same characters and a detailed description is omitted:

The inkjet recording head 10 of the present embodiment has a head chip 12 fixed at the tip of the housing 11 as shown in FIG. 13.

Figure 12A:
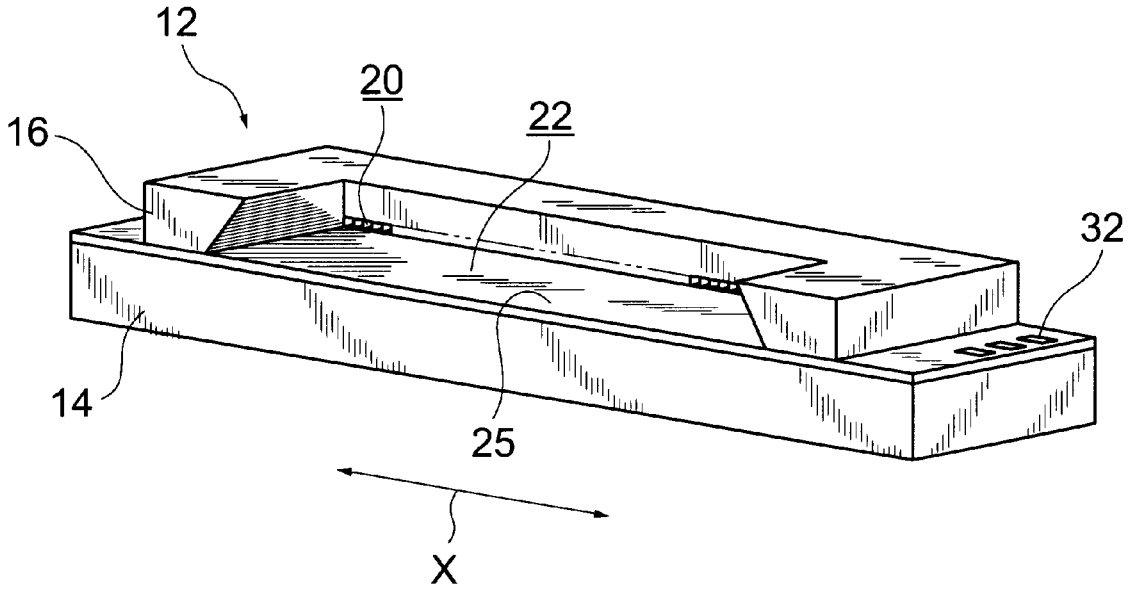
FIG. 12A is a perspective view illustrating a head chip and a common liquid chamber in accordance with the fifth embodiment of the present invention.
Figure 12B:
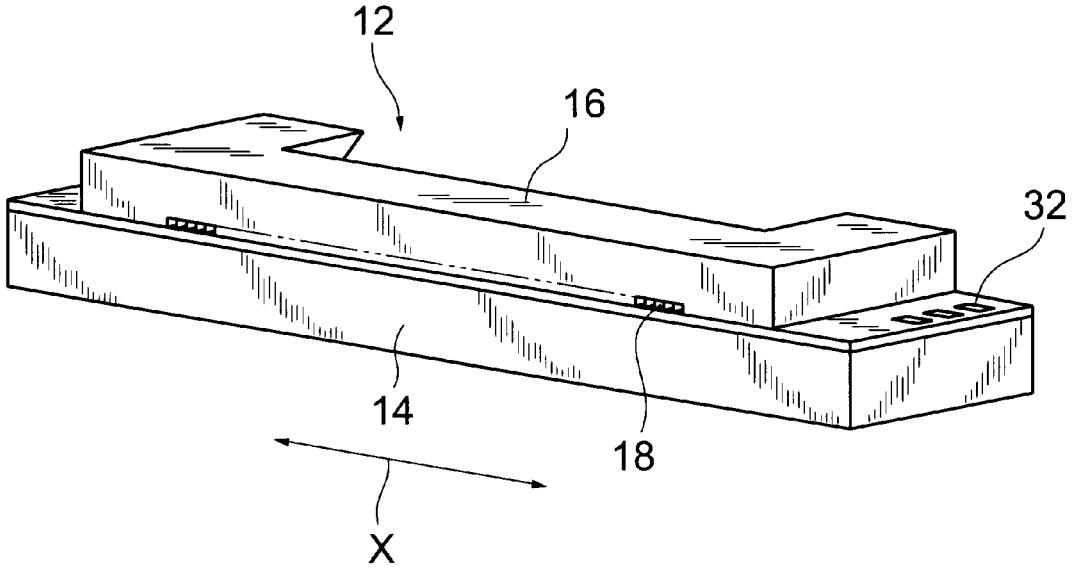
FIG. 12B is a perspective view illustrating the discharging side of the head chip.

The head chip 12 is formed by joining a pressure generation side substrate 14 and a flow passage substrate 16, and the flow passage substrate 16 has a concave common liquid chamber 22 having an opening on the opposite side to the side where the nozzle 18 of the individual flow passage 20 is formed as shown in FIG. 12A. Herein, the common liquid chamber 22 is formed by mounting the head chip 12 on the housing 11.

The common liquid chamber 22 that is formed approximately rectangular has an ink inlet 32 on the opposite side to the head chip 12 for receiving ink from an ink tank or the like, and is communicated to the other ends of the respective individual flow passages 20 through a recess 25 of the head chip 12 (flow passage substrate 16).

As shown in FIG. 13, the continuous arrangement of the wall surface 11B of the housing 11 and the pressure generation part forming surface 14A of the pressure generation side substrate 14 functions to guide the ink that has flowed from the ink inlet 32 into the common liquid chamber 22 to flow into the individual flow passages 20 along the above-mentioned wall surface 11B and the pressure generation part forming surface 14A.

Ink is supplied from an ink tank not shown in the drawing, enters from the ink inlet 32 into the common liquid chamber 22, and supplied to individual flow passages 20. Ink droplets 36 are discharged by being pressured from the pressure generation part 24 in the individual flow passages 20, and printed on a recording medium 38.

An embodiment may be employed, in which the ink inlet 32 shown in FIG. 13 is not provided, a common liquid chamber 22 on which a head chip has been mounted is served as an ink tank together with the housing 11 wherein the inside wall of the flow passage substrate 16 forms a part of the inside wall of a closed ink tank.

In the present embodiment, the ink supply members for supplying ink from the external to the ink supply opening 26 (refer to FIG. 4A) of the head chip 12 and the seal member used for connection are not needed, and processes for preparation and manufacture of these members are not necessary unlike the first embodiment, the low-cost inkjet recording head can be obtained with simple process. Furthermore, because it is possible to provide a common liquid chamber 22 having a sufficiently large volume, in the case where a heating element is employed as the pressure generating part 24, the excessive heat stored in the pressure generation side substrate 14 caused from heating is released to the ink that is in contact with the pressure generation side substrate 14. If the ink temperature is elevated to a value higher than a certain temperature, bubbles are taken in from the nozzle 18 and the printing is involved in a problem. If a common liquid chamber 22 has a sufficiently large (liquid) volume, the ink can cause convection. That is, the ink that is heated in the common liquid chamber moves upward, and the ink that is cooled moves downward.

<Inkjet Recording Apparatus>

Sixth Embodiment

Figure 11:
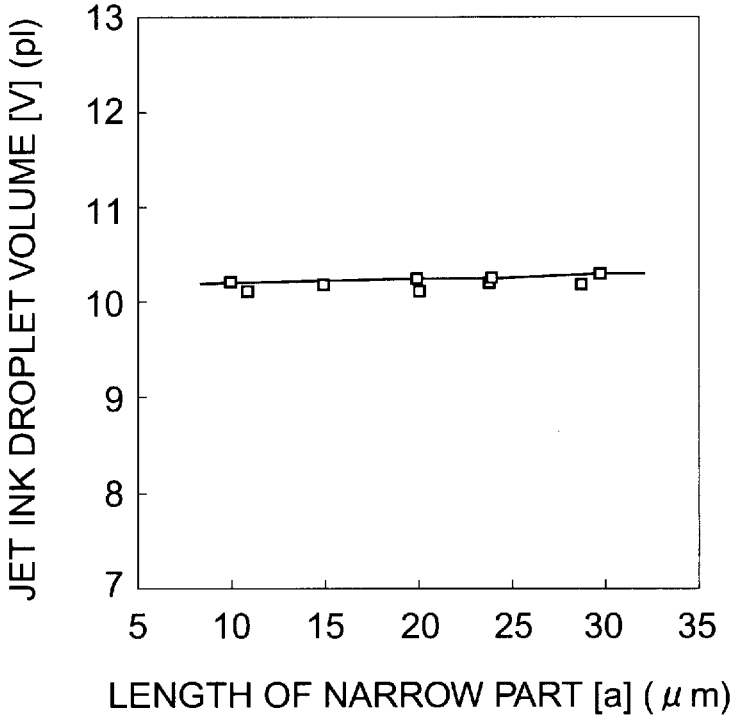
FIG. 11 is a graph for describing the relation between the length a of a first narrow part and the ejected ink droplet volume V for an inkjet recording head in accordance with the first embodiment of the present invention.
Figure 14:
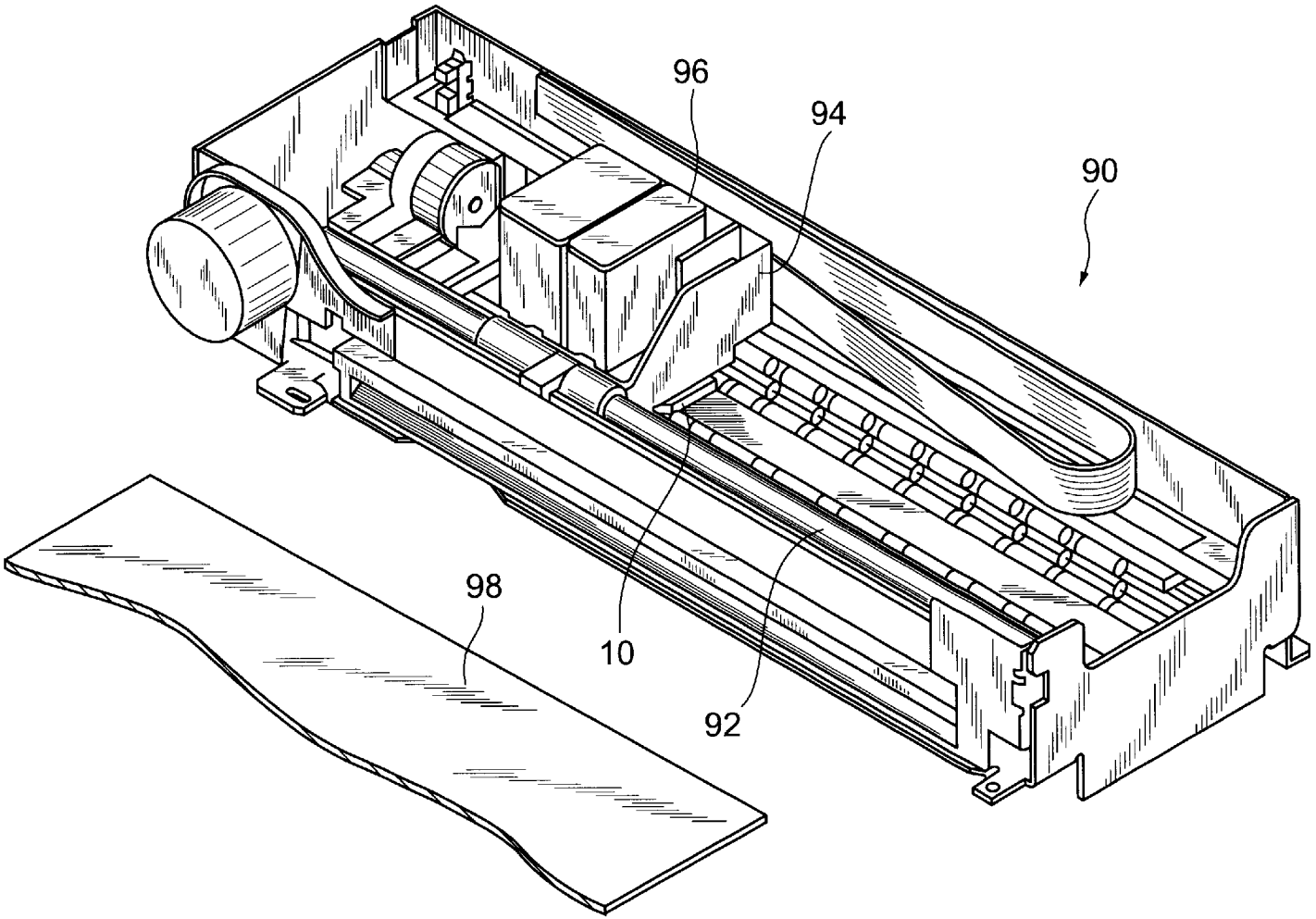
FIG. 14 is a perspective view of an inkjet recording apparatus in accordance with the sixth embodiment of the present invention.

An inkjet recording apparatus in accordance with the sixth embodiment of the present invention will be described with reference to FIG. 14. The same components as used in the first to fifth embodiments are given the same characters and a detailed description is omitted. FIG. 11 is a schematic perspective structural view illustrating an exemplary inkjet recording apparatus on which an inkjet recording head of each embodiment is mounted.

The inkjet recording apparatus 90 is provided with an ink supply unit 96 mounted on a carriage 94 along a guide shaft 92 and an inkjet recording head 10 (not limited to the first embodiment).

The inkjet recording apparatus 90 having the structure described hereinabove exhibits the stable printing discharging performance because the seal of the inkjet recording head 10 is secured sufficiently.

Herein, any recordable medium such as paper, post card, or cloth may be used as the recording medium 98. The recording medium 98 is carried by means of a carrying mechanism to the position corresponding to the inkjet recording head 10.

The inkjet recording apparatus of the present invention ejects ink droplets having a constant drop volume stably, and forms a sharp and high quality image because the inkjet recording apparatus is provided with the above-mentioned inkjet recording head of the present invention. Moreover, as described hereinabove, the low cost of the inkjet recording head itself implements the low-cost inkjet recording apparatus.

According to the present invention, an inkjet recording head is provided, which is capable of compensating the drop volume change due to cutting position deviation in dicing caused when nozzles are formed by cutting, and capable of ejecting ink droplets having a constant drop volume stably regardless of the flow passage length, in manufacturing of which inkjet recording head less manufacturing processes. are required, less off-specification products are produced, and the products are manufactured at low cost. A low-cost inkjet recording apparatus provided with the above-mentioned inkjet recording head that is capable of ejecting ink droplets having a constant drop volume and forming a high quality image is provided.

Furthermore, according to the present invention, a method for manufacture of inkjet recording heads is provided easily and at low cost, in which method the inspection process for inspecting the cutting position is not required, generation of off-specification products is significantly suppressed, drop volume change due to cutting position deviation in dicing is compensated, which inkjet recording head is capable of ejecting ink droplets having a constant drop volume stably.

The entire disclosure of Japanese Patent Application No. 2000-213049 filed on Jul. 13, 2000 including specification, claims, drawings and abstract is incorporated herein by reference in its entirety.

What is claimed is:

1. An inkjet recording head comprising:

a head chip on which an ink discharging mechanism is mounted, the ink discharging mechanism having at least individual flow passages each having a nozzle at one end thereof and a pressure generation part with a pressure generation plane positioned in parallel to a direction of flow of ink in the nozzle; and a common liquid chamber communicated commonly to plural individual flow passages that supplies ink to the individual flow passages, wherein the individual flow passage has a region having a maximum cross-sectional area, a reducing region where a cross-sectional area thereof reduces from the maximum cross-sectional area to a minimum cross-sectional area, and an expansion region where a cross-sectional area thereof increases from the minimum cross-sectional area successively from the pressure generation part toward the nozzle, the regions being perpendicular to the ink flow direction.

2. The inkjet recording head according to claim 1, wherein the cross-sectional area of the expansion region increases so as to almost offset an increase of a flow passage resistance caused by making the individual flow passage of the expansion region longer.

3. The inkjet recording head according to claim 1, wherein the cross-sectional area of the expansion region increases so as to keep an ejected ink droplet volume almost unchanged even if the individual flow passage of the expansion region is made longer.

4. The inkjet recording head according to claim 1, wherein the cross-sectional area of the nozzle that is formed at one end of the individual flow passage is one to two times as large as the minimum cross-sectional area.

5. The inkjet recording head according to claim 1, wherein the expansion region includes an increasing region where the cross-sectional area thereof increases in proportion to a length of the expansion region in the ink flow direction.

6. The inkjet recording head according to claim 5, wherein an increasing rate of the cross-sectional area that increases from the nozzle side end of the increasing region toward the nozzle end is smaller than the increasing rate of the cross-sectional area of the increasing region.

7. The inkjet recording head according to claim 1, wherein a nozzle surface having an opening is formed by cutting a substrate comprising a pressure generation side substrate provided with the pressure generation part and a flow passage substrate.

8. An inkjet recording apparatus comprising the inkjet recording head according to claim 1.

* * * * *